US009109274B2

(12) United States Patent
Kou

(10) Patent No.: US 9,109,274 B2
(45) Date of Patent: Aug. 18, 2015

(54) HIGH-TENSION STEEL PLATE EXCELLENT IN BASE METAL TOUGHNESS AND HAZ TOUGHNESS

(71) Applicant: Kobe Steel, Ltd., Kobe-shi (JP)

(72) Inventor: Hiroaki Kou, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 179 days.

(21) Appl. No.: 13/869,521

(22) Filed: Apr. 24, 2013

(65) Prior Publication Data

US 2014/0003990 A1 Jan. 2, 2014

(30) Foreign Application Priority Data

Jun. 29, 2012 (JP) ..... 2012-147891

(51) Int. Cl.

| | |
|---|---|
| ***C22C 38/54*** | (2006.01) |
| ***C22C 38/32*** | (2006.01) |
| ***C22C 38/50*** | (2006.01) |
| ***C22C 38/48*** | (2006.01) |
| ***C22C 38/44*** | (2006.01) |
| ***C22C 38/28*** | (2006.01) |
| ***C22C 38/26*** | (2006.01) |
| ***C22C 38/22*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| *C21D 8/02* | (2006.01) |

(52) U.S. Cl.

CPC ..... *C22C 38/54* (2013.01); *C21D 8/0263* (2013.01); *C21D 9/46* (2013.01); *C22C 38/001* (2013.01); *C22C 38/005* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C22C 38/44* (2013.01); *C22C 38/48* (2013.01); *C22C 38/50* (2013.01); *C21D 8/0226* (2013.01); *C21D 2211/002* (2013.01); *C21D 2211/008* (2013.01)

(58) Field of Classification Search

CPC ..... C22C 38/02–38/08; C22C 38/12; C22C 38/14; C22C 38/18; C22C 38/22; C22C 38/26; C22C 38/28; C22C 38/32; C22C 38/44; C22C 38/48; C22C 38/50; C22C 38/54

USPC ..... 148/331, 333, 334; 420/83, 105–110

See application file for complete search history.

(56) References Cited

FOREIGN PATENT DOCUMENTS

| | | | | |
|---|---|---|---|---|
| CN | 101460647 | A | 6/2009 | |
| CN | 102251175 | A | 11/2011 | |
| EP | 2053140 | A1 * | 4/2009 | ..... C22C 38/14 |
| JP | 2009-242832 | A | 10/2009 | |
| KR | 10-2010-0057504 | A | 5/2010 | |

* cited by examiner

*Primary Examiner* — Brian Walck

(74) *Attorney, Agent, or Firm* — Oblon, McClelland, Maier & Neustadt, L.L.P.

(57) ABSTRACT

The steel plate of the invention is a high-tension steel plate that has a tensile strength of 1100 MPa or more and is excellent in base metal toughness and HAZ toughness and preferably in abrasion resistance. The steel plate satisfies a predetermined requirement of components in the steel. The Ceq (IIW) represented by the following equation ranges from 0.40 to 0.45 both inclusive:

$$Ceq(IIW)=[C]+\{1/6\times[Mn]\}+\{1/5\times([Cr]+[Mo]+[V])\}+\{1/15\times([Cu]+[Ni])\}$$

in which each parenthesis-symbol [ ] means the content by percentage of an element in the parentheses. Oxide grains having a maximum diameter of 2 μm or less are present in a number density of 200/mm$^2$ or more in the steel. The steel is composed of 29% or more by volume of martensite microstructure, and bainite microstructure as the balance.

6 Claims, 1 Drawing Sheet

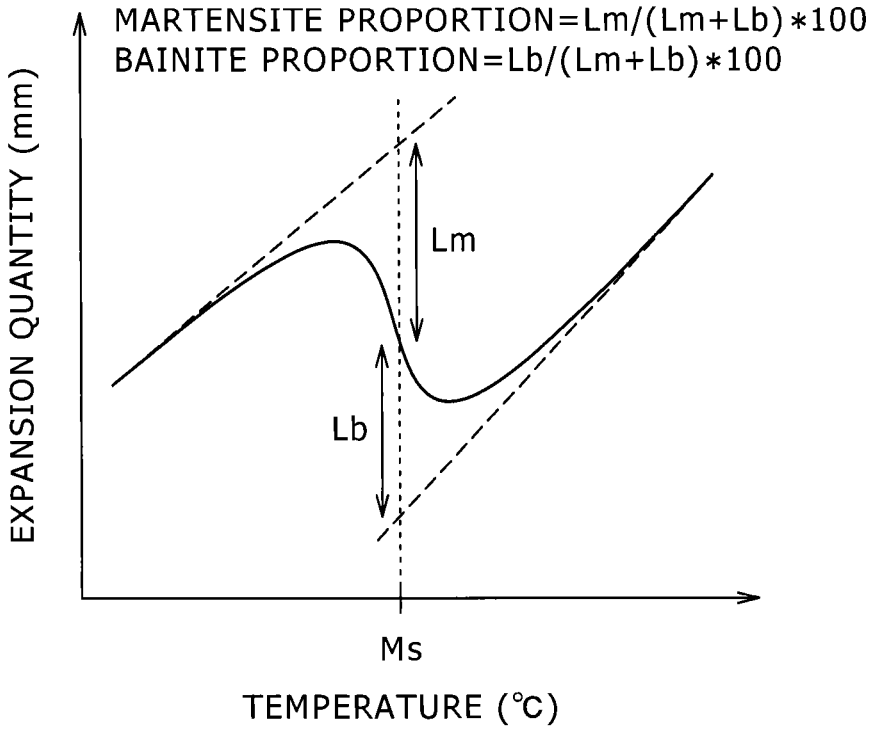
MARTENSITE PROPORTION=Lm/(Lm+Lb)*100
BAINITE PROPORTION=Lb/(Lm+Lb)*100
EXPANSION QUANTITY (mm)
Lm
Lb
Ms
TEMPERATURE (℃)

HIGH-TENSION STEEL PLATE EXCELLENT IN BASE METAL TOUGHNESS AND HAZ TOUGHNESS

BACKGROUND OF THE INVENTION

1. Field of the Invention

The present invention relates to a high-tension steel plate which has a tensile strength of 1100 MPa or more, and is excellent in base metal toughness and heat-affected zone (HAZ) toughness. The high-tension steel plate of the invention is used suitable as a thick steel plate used for construction machinery, industrial machinery and others.

2. Description of Related Art

A thick steel plate used for construction machinery, industrial machinery and others has been required to have a higher-strength performance with a recent increase of needs that steel plates should be made lighter. The thick steel plate used for these products is also required to have a high toughness (each of base metal toughness and HAZ toughness). In general, however, the strength and the toughness tend to be conflicting with each other. As the strength becomes higher, the toughness becomes lower.

For example, JP 2009-242832 A describes a technique of a high-tension steel plate which is excellent in bending workability while maintaining a high strength that is a tensile strength (TS) of 980 MPa or more. This prior art attains an expected object by using a component system to which none of elements high in solid-solution strengthening power, such as Cu and Ni, which have been hitherto added to make steel higher in strength, are added, and further adding respective appropriate amounts of Ti and Nb thereto, thereby making the prior austenite (γ) grain diameter finer.

However, according to this prior art, components in the steel are not appropriately controlled, so that the steel cannot ensure a high HAZ toughness. According to the prior art, Ti is added thereto to control the microstructure. However, the present inventors' investigations have demonstrated that the steel is deteriorated in base metal toughness, in the range of high strengths of 980 MPa or more, by effect of a Ti inclusion.

Furthermore, a thick steel plate used for construction machinery, industrial machinery and others is preferably required to have an excellent abrasion resistance besides high strength and toughness. Generally, the abrasion resistance and the hardness of a thick steel plate are correlative to each other. Thus, a thick steel plate concerned for being abraded needs to be made high in hardness. In order to ensure a stable abrasion resistance, the thick steel plate needs to have a hardness even over its regions from its surface to its plate-thickness-direction internal portion (near t/2 wherein t is the thickness) (i.e., to be similar in hardness between the surface and the internal portion of the thick steel plate).

SUMMARY OF THE INVENTION

In light of such a situation, the present invention has been made, and an object thereof is to provide a high-tension steel plate which is a high-strength steel plate having a tensile strength of 1100 MPa or more and is additionally excellent in base metal toughness and HAZ toughness and preferably in abrasion resistance.

The steel plate which can solve the above-mentioned problems is (1) a steel plate comprising the following as components in the steel: C: 0.10 to 0.16% provided that the symbol "%" means "% by mass" and hereinafter the same matter is applied to any symbol "%" described in connection with each of the components, Si: 0.2 to 0.5%, Mn: 1 to 1.4%, P: 0.03% or less, S: 0.01% or less, Al: 0.010 to 0.08%, Cr: 0.03 to 0.25%, Mo: 0.25 to 0.4%, Nb: 0.01 to 0.03%, B: 0.0003 to 0.002%, N: 0.006% or less, REMs: 0.0005 to 0.0030%, Zr: 0.0003 to 0.0020%, Fe and one or more inevitable impurities as the component-balance of the steel, wherein the Ceq (IIW) represented by the following equation ranges from 0.40 to 0.45 both inclusive:

$$Ceq(IIW)=[C]+\{1/6\times[Mn]\}+\{1/5\times([Cr]+[Mo]+[V])\}+\{1/15\times([Cu]+[Ni])\}$$

in which each parenthesis-symbol [ ] means the content by percentage of one of the elements in the parentheses, and (2) grains of one or more oxides that each have a maximum diameter of 2 μM or less are present in a number density of 200/mm$^2$ or more, (3) martensite microstructure is contained in a proportion of 29% or more by volume, and the microstructure-balance of the steel is bainite microstructure, the steel plate having a tensile strength of 1100 MPa or more.

Preferably, the steel in the invention further comprises, as another element, Ni: 0.25% or less.

Since the steel plate of the invention is structured as described above, the steel plate is a high-strength steel plate which has a tensile strength of 1100 MPa or more, and is simultaneously excellent in base metal toughness and HAZ toughness and preferably in abrasion resistance.

BRIEF DESCRIPTION OF THE DRAWINGS

FIG. 1 is a thermal expansion curve used to measure the ratio by volume between microstructures.

DESCRIPTION OF THE PREFERRED EMBODIMENTS

The inventors have repeatedly made eager investigated to solve the above-mentioned problems. As a result, the inventors have found out that the expected object can be attained by controlling appropriately components in steel, the carbon equivalent Ceq(IIW) thereof, the microstructure thereof, and the number density of grains of an oxide therein. Thus, the invention has been achieved.

In the present specification, the wording "excellent in base metal toughness and HAZ toughness" means that when these properties of a steel are examined by methods described in working examples that will be described later, the base toughness and the HAZ toughness satisfy the following, respectively: $vE^{-70}\geq 20$ J, and $VE_0\geq 100$ J.

In the specification, the wording "excellent in abrasion resistance" means that when measurements are made about the Brinell hardness of any surface of a steel plate, and that of an internal portion (t/2 wherein t is the thickness of the plate; hereinafter, "t" denotes the thickness of a steel plate) of the plate, the hardnesses are each 360 or more.

In the specification, the wording "thick steel plate" means a steel plate having a plate thickness of 6 mm or more.

First, the components in the steel in the invention will be described.

C: 0.10 to 0.16%

C is an element necessary and essential for ensuring the strength and hardness of the base metal (steel plate). In order to cause such an effect to be effectively exhibited, the lower limit of the C content by percentage (referred to merely as the content hereinafter) is set to 0.10%. This lower limit is preferably 0.12%. However, if the C content becomes excessive, the steel is deteriorated in HAZ toughness. Thus, the upper limit of the C content is set to 0.16%. This upper limit is preferably 0.15%.

Si: 0.2 to 0.5%

Si is an element which has a de-oxidizing effect and is effective for improving the strength of the base metal. In order to cause such an effect to be effectively exhibited, the lower limit of the Si content is set to 0.2%. This lower limit is preferably 0.3%. However, if the Si content becomes excessive, the steel is deteriorated in weldability. Thus, the upper limit of the Si content is set to 0.5%. This upper limit is preferably 0.40%.

Mn: 1 to 1.4%

Mn is an element effective for improving the base metal in strength. In order to cause such an effect to be effectively exhibited, the lower limit of the Mn content is set to 1%. This lower limit is preferably 1.10%. However, if the Mn content becomes excessive, the steel is deteriorated in weldability. Thus, the upper limit of the Mn content is set to 1.4%. This upper limit is preferably 1.3%.

P: 0.03% or less

P is an element contained inevitably in the steel material. If the P content is more than 0.03%, the base metal is deteriorated in toughness. Thus, the upper limit of the P content is set to 0.03%. The P content is favorably made as small as possible so that the upper limit of the P content is preferably 0.020%.

S: 0.01% or less

S is an element contained inevitably in the steel material. If the S content is too large, MnS is generated in a large proportion so that the base metal is deteriorated in toughness. Thus, the upper limit of the S content is set to 0.01%. The S content is favorably made as small as possible so that the upper limit of the S content is preferably 0.004%.

Al: 0.010 to 0.08%

Al is an element used for de-oxidization. In order to cause such an effect to be effectively exhibited, the lower limit of the Al content is set to 0.010%. However, if the Al content is more than 0.08%, the cleanability of the steel plate is hindered. Thus, the upper limit of the Al content is set to 0.08%. This upper limit is preferably 0.065%.

Cr: 0.03 to 0.25%

Cr is an element effective for improving the base metal in strength. In order to cause such an effect to be effectively exhibited, the lower limit of the Cr content is set to 0.03%. This lower limit is preferably 0.05%. However, if the Cr content is more than 0.25%, the steel is deteriorated in weldability. Thus, the upper limit of the Cr content is set to 0.25%. This upper limit is preferably 0.20%.

Mo: 0.25 to 0.4%

Mo is an element effective for improving the base metal in strength and hardness, in particular, in internal hardness at the t/2 position of the metal. In order to cause such an effect to be effectively exhibited, the lower limit of the Mo content is set to 0.25%. This lower limit is preferably 0.28%. However, if the Mn content is more than 0.4%, the steel is deteriorated in weldability. Thus, the upper limit of the Mo content is set to 0.4%. This upper limit is preferably 0.35%.

Nb: 0.01 to 0.03%

Nb is an element effective for heightening the base metal in strength and toughness. In order to cause such an effect to be effectively exhibited, the lower limit of the Nb content is set to 0.01%. This lower limit is preferably 0.015%. However, if the Nb content is more than 0.03%, coarse precipitates are generated so that the base metal toughness is reversely deteriorated. Thus, the upper limit of the Nb content is set to 0.03%. This upper limit is preferably 0.025%.

B: 0.0003 to 0.002%

B is an element effective for heightening the steel in quenchability to improve the base metal and the welded region (HAZ region) in strength. In order to cause such an effect to be effectively exhibited, the lower limit of the B content is set to 0.0003%. This lower limit is preferably 0.0005%. However, if the B content becomes excessive, the steel is deteriorated in weldability. Thus, the upper limit of the B content is set to 0.002%. This upper limit is preferably 0.0015%.

N: 0.006% or less

N is an element contained inevitably in the steel material. If the N content is too large, a solid solution of N is present so that the base metal toughness is deteriorated. Thus, the upper limit of the N content is set to 0.006%. The N content is favorably made as small as possible so that the upper limit of the N content is preferably 0.0050%.

REMs: 0.0005 to 0.0030%

REMs (rare earth elements) are each an element which is to form an oxide to improve the HAZ toughness. In order to cause such an effect to be effectively exhibited, the lower limit of the REM content is set to 0.0005%. This lower limit is preferably 0.0010%, more preferably 0.0015%. However, if the REM content becomes excessive, a coarse inclusion is produced so that the HAZ toughness is deteriorated. Thus, the upper limit of the REM content is set to 0.0030%. This upper limit is preferably 0.0025%.

In the invention, the REMs mean lanthanide elements (15 elements from La to Lu), Sc (scandium) and Y. In the invention, the REMs may be added alone or in combination of two or more thereof. The REM content means, when the REMs may be added alone, the content of only the added REM; or means, when the REMs are added in the combination, the total content thereof. In the working examples, which will be described later, the REMs were added in the form of a mischmetal (containing about 50% of Ce and about 30% of La).

Zr: 0.0003 to 0.0020%

Zr is an element which is to form an oxide to improve the steel in HAZ toughness. In order to cause such an effect to be effectively exhibited, the lower limit of the Zr content is set to 0.0003%. This lower limit is preferably 0.0005%. However, if the Zr content becomes excessive, a coarse inclusion is produced so that the HAZ toughness is deteriorated. Thus, the upper limit of the Zr content is set to 0.0020%. This upper limit is preferably 0.015%.

The high-tension steel plate of the invention satisfies the requirements of the above-mentioned components therein. The component-balance of the steel plate is composed of iron and inevitable impurities.

Ceq (IIW); 0.40 to 0.45%

In the invention, it is necessary not only to control the respective contents of the components in the steel as described above but also to control the carbon equivalent Ceq represented by the above-mentioned equation into the predetermined range. As has been verified in the working examples, which will be described later, even when the individual components in the steel satisfy the respective ranges, the steel cannot ensure desired properties if The Ceq (IIW) is out of the range specified in the invention.

Specifically, the Ceq (IIW) is a factor essential for causing the steel to ensure base metal strength, HAZ toughness, and hardness. In order to cause such an effect to be effectively exhibited, the lower limit of the Ceq (IIW) is set to 0.40%. This lower limit is preferably 0.41%. However, if the Ceq (IIW) is too high, the HAZ toughness is deteriorated. Thus, the upper limit of the Ceq (IIW) is set to 0.45%.

Ni: 0.25% or less

Ni is an element effective for improving the base metal in strength and toughness. Ni is optionally added into the invention. In order to cause such an effect to be effectively exhibited, the lower limit of the Ni is preferably set to 0.05%, more preferably to 0.10%. However, if the Ni content becomes excessive, the steel is deteriorated in weldability. Thus, the upper limit of the Ni content is preferably set to 0.25%, more preferably to 0.20%.

The high-tension steel plate of the invention does not contain Ti. As has been verified by the working examples, which will be described later, this is because the addition of Ti makes the steel low in base metal toughness and HAZ toughness in the range of high strengths of 1100 MPa or more.

The following will describe microstructures of the steel.

As described above, the high-tension steel plate of the invention is structured to contain martensite microstructure and bainite microstructure. The steel plate satisfies a requirement that the proportion by volume of martensite in the entire microstructures (martensite+bainite) is 29% or more. By making the steel plate into a two-phase microstructure of martensite and bainite in this way, the steel plate can ensure a high strength of 1100 MPa or more.

In the invention, martensite is a microstructure essential for causing the steel to ensure base metal strength and hardness (internal hardness) at the t/2 position of the base metal. In order to cause such an effect to be effectively exhibited, the proportion by volume of martensite is set to 29% or more. As has been verified by the working examples, which will be described later, if the proportion of martensite is small, a desired high strength of 1100 MP or more is not obtained. Alternatively, even when the steel obtains the high strength, the plate is lowered in internal hardness to be declined in abrasion resistance. The proportion of martensite is preferably 30% or more.

In the invention, martensite contains, in the category thereof, both of quenched martensite, which is obtained by quenching, and tempered martensite, which is obtained by tempering. As will be described in greater detail, the steel plate of the invention may be in either of these two forms since the steel plate may be produced by hot-rolling an ingot and then subjecting the rolled ingot to quenching (Q) [without tempering (T)], or subjecting the rolled ingot to quenching (Q) followed by tempering (T).

In the invention, the proportion of martensite needs only to be controlled as described above. Thus, it does not matter which of the proportion of martensite and that of bainite is larger. In other words, in the invention, martensite may be present as a main component (i.e., in a proportion of 50% or more by volume of the entire microstructures), or bainite may be present as a main component (i.e., in a proportion of 50% or more by volume of the entire microstructures).

The ratio by volume between martensite and bainite (the proportion by volume of each of the two) is measured on the basis of a thermal expansion curve of the steel obtained by use of a hot-working reproducing tester, and the Ms point thereof (a method for calculating out the Ms point will also be described later). As described above, martensite is classified into quenched martensite and tempered martensite; however, even when the steel is tempered, the steel is not varied in ratio by volume between these microstructures.

The following will describe the number density of grains of one or more oxides in the steel.

In the invention, it is necessary that grains of one or more oxides that have a maximum diameter of 2 μm or less are present in a number density of 200/mm$^2$ or more in the steel. In this manner, the steel is improved in HAZ toughness.

Examples of the oxide(s) include REM-containing oxides, Zr-containing oxides, and oxides each containing both of the REM(s) and Zr. These oxides may each contain an element other than the REM and Zr. The element may be, for example, Al or Si, which is an oxide-forming element.

Specifically, according to a method in the example that will be described later, the steel needs to contain grains of the oxide(s) that have a maximum diameter of 2 μm or less in a number density of 200/mm$^2$ or more, the density being according to a method described in the working examples, which will be described later. The wording "maximum diameter" is a value obtained when the dimensions of each of the grains of the oxide(s) are measured by a method that will be described later, and means the measured maximum length. The reason why attention has been paid to the oxide grains each having this size is that many basic experiments by the inventors have demonstrated that in order to improve the toughness (particularly the HAZ toughness) in the range of high strengths of 1100 MPa or more as aimed in the invention, it is very effective to control the number density of the oxide grains having the size appropriately.

As the number density of the oxide grains is larger, the toughness (particularly the HAZ toughness) tends to be made higher. The number density is preferably 230/mm$^2$ or more.

The above has described the components in the steel, the Ceq, the microstructures, and the number density of the oxide grains, by which the invention is characterized.

The high-tension steel plate of the invention is preferably a steel plate excellent in abrasion resistance. It is preferred therefor that any surface and the inside of the steel plate each have a Brinell hardness of 360 or more. About conventional abrasion-resistant steel plates, the abrasion resistance thereof is usually ensured through only the Brinell hardness of the surfaces of the steel plates; however, this way makes it impossible to ensure a stable abrasion resistance. Thus, in the invention, each of the two Brinell hardnesses is preferably specified into 360 or more in order to keep the hardness of the steel plate, over regions from the surface thereof to the inside thereof, at substantially the same high level (at an evenly high level) surely to ensure a stable abrasion resistance certainly.

It does not matter which of the surface and the inside of the steel plate has a larger hardness as far as the steel plate satisfies the above-mentioned requirements. In other words, any one of the following is acceptable: the steel plate surface hardness>the steel plate inside hardness; the surface hardness<the inside surface; and the surface hardness the inside hardness.

A production method for obtaining the steel plate of the invention is not particularly limited. The steel plate can be produced by hot-rolling a melted steel satisfying the composition of the components in the invention, and subjecting the rolled steel to quenching (and optional tempering). In order to cause the steel plate to ensure the desired microstructures and number density of the oxide grains, it is recommendable to produce the steel plate by, for example, the following method:

First, de-oxidizing elements such as Mn, Si and Al are added to a melted steel of 1550 to 1700° C. temperature. The order of adding these elements is not particularly limited. Next, REMs and Zr are added thereto. It is preferred to stir the melted metal for 10 minutes or more after the addition of the de-oxidizing elements, and subsequently add the REMs and Zr for the following reason: the de-oxidizing elements easily produce coarse oxide grains; when the REMs and Zr, which are more intense in oxidizing power than the de-oxidizing elements, are added thereto, the REMs and Zr reduce coarse oxide grains, and these oxide grains become coarser to reduce the production amount of desired fine oxide grains, which have a maximum diameter of 2 μm or less. As described above, in the case of stirring the melted metal for 10 minutes or more after the addition of the de-oxidizing elements, and subsequently adding the REMs and Zr, the coarse oxide grain amount is decreased so that a desired number density of the fine oxide grains can be ensured. However, if the stirring period in this case is too long, the steel plate is hindered in productivity. Thus, the period is preferably set to about 150 minutes or less.

Next, after the addition of the REMs and Zr, the melted metal is stirred, and then the metal is cast. The stirring period from the addition of the REMs and Zr to the casting is preferably controlled into the range of 1 to 30 minutes both inclusive. When the stirring period is 1 minute or longer, oxide grains produced to have a maximum diameter of 2 μm or less at the time of the addition of the REMs and Zr can be evenly into the steel. When the stirring period is 30 minutes or shorter, the number of the oxide grains having a maximum diameter of 2 μm or less can be prevented from being decreased by the production of the above-mentioned coarse oxide grains.

In order to produce a thick steel plate of the invention, it is advisable to use a melted steel satisfying the above-mentioned component composition, and hot-roll this composition under ordinary conditions (the rolling temperature and the rolling reduction ratio).

Next, the rolled steel is quenched. In order to cause the steel plate to be quenched inside in thickness, it is preferred to quench the steel plate at a temperature of 880° C. or higher.

In the invention, the steel plate may be a quenched steel plate (Q steel plate) as described above. If necessary, the steel plate may be tempered after the quenching to decrease the plate in remaining stress. In order to cause the steel plate to ensure a desired number density of the oxide grains and further ensure appropriate microstructures, it is preferred, for example, to quench the steel at a temperature of 880° C. or higher and temper the steel at a temperature of 500° C. or lower.

EXAMPLES

Hereinafter, the invention will be more specifically described by way of a working example and a comparative example. However, the invention is not limited by the working example. The example may be performed by adding a change or modification thereto as far as the resultant techniques are each adapted to the subject matters of the invention that have been described above and will be described hereinafter. These techniques are included in the technical scope of the invention.

Example 1 and Comparative Example 1

Melted steels satisfying respective component compositions in Table 1 (steel species A to G each according to Example 1, and steel species H to R each according to Comparative Example 1) were used, and the steels were hot-rolled and quenched (and some of the steels were further tempered) to produce thick steel plates (thickness: 20 mm).

Specifically, a vacuum melting furnace (150 kg) was used. Mn, Si and Al were first added to each of the melted steels of 1550 to 1700° C., and then the steel was stirred for 20 to 40 minutes. Thereafter, REMs and Zr were added thereto. The melted steel was stirred for 2 to 10 minutes and then made into an ingot. Thereafter, the resultant ingot steel was cooled to obtain a slab (sectional shape: 120 mm×180 mm).

Next, the slab was heated to 1100° C. and hot-rolled to obtain a hot-rolled plate having a plate thickness of 20 mm. Details of conditions for the hot rolling are as follows:

Heating temperature: 1100° C.

Finishing temperature: 900 to 1000° C.

Cooling method: air cooling

Next, as shown in Table 2, the steel plate was heated to 930° C., and then quenched (Q). In this way, each steel plate (Q steel plate) was produced. As shown in Table 2, after the quenching, some of the steel plates were heated to 350° C. to be tempered (T). Thus, thick steel plates (QT steel plates) were obtained.

About each of the thus obtained steel plates, properties thereof were measured or evaluated as follows:

(1) Measurement of Respective Proportions of Metal Microstructures

The respective proportions of martensite and bainite therein were measured as follows: First, from each of the slabs, a columnar specimen was collected which had a diameter of 8 mm and a thickness of 12 mm. A hot-working reproducing tester was used to examine a continuous cooling transformation property thereof (shown by a thermal expansion curve thereof). Detailedly, the specimen was heated to 930° C., and then cooled to room temperature at an average cooling rate of 26° C./second to measure a thermal expansion curve of the specimen. This average cooling rate is a simulated rate of the average cooling rate of the t/2 position of a steel plate having a plate thickness of 20 mm.

FIG. 1 shows a result of typical one of the thus obtained thermal expansion curves. The transvers axis (of the graph) in FIG. 1 represents the temperature (° C.) of the specimen; the vertical axis, the expansion quantity (mm) of the diameter of the specimen. As shown in FIG. 1, the following were observed: a shrinkage of the specimen by the cooling thereof; and a cubical expansion (or dilation) of the specimen when the steel was transformed from austenite (γ) to ferrite (α). In the present examples, the martensite transformation point (Ms point) of each of the steels was calculated out in accordance with the following equation:

$$Ms=550-361\times[C]-39\times[Mn]-20\times[Cr]-17\times[Ni]-5\times[Mo]+30\times[Al],$$

the source of which is the Japan Institute of Metals and Materials, "Lecture: Modern Metallography, Material Book, Vol. 4, Steel Materials", Marzen, 2006, p 45. In a manner shown in FIG. 1, measurements were made about the martensite proportion (the proportion of the region transformed after the MS point), and the bainite proportion (the proportion of the region the transformation of which had been already finished). In the present examples, any steel plate about which the martensite proportion measured in this way was 29% or more, out of all the plates, was judged to be acceptable.

(2) Tensile Test

From each of the steel plates obtained as described, a No. 5 specimen (total-thickness tension specimen) prescribed in JIS Z 2201 was collected, and then a tensile test was made thereabout by a method prescribed in JIS Z 2201 to measure the TS (tensile strength) and the YP (yield stress). In the present examples, any steel plate about which the TS was 1100 MPa or more, out of all the plates, was judged to be excellent in strength (acceptable).

(3) Method for Evaluating Base Metal Toughness

About each of the steel plates obtained as described above, a 2-mm V-notch specimen prescribed in JIS Z 2242 was collected from a t/4 position thereof, wherein t is the plate thickness, along the C direction. By a method prescribed in JIS Z 2242, a Charpy impact test was made thereabout to measure the absorbed energy at −70° C. ($vE_{-70}$). In the present examples, any steel plate about which the $vE_{-70}$ was 20 J or more, out of all the plates, was judged to be excellent in base metal toughness (acceptable).

(4) Method for Evaluating HAZ Toughness (Test Method for Synthetic HAZ)

About each of the steel plates obtained as described, a specimen for heat cycle was collected. In order to simulate an HAZ when the specimen was welded, the specimen was subjected to a predetermined heat cycle (the specimen was heated to 1350° C., kept at the temperature for 5 seconds, and cooled in a temperature range of 800 to 500° C. over 7 seconds). From the specimen subjected to the heat cycle, a 2-mm V-notch specimen prescribed in JIS Z 2242 was collected. By the method prescribed in JIS Z 2242, a Charpy impact test was made thereabout to measure the absorbed energy at 0° C. ($vE_0$). In the present examples, any steel plate about which the $vE_0$ was 100 J or more, out of all the plates, was judged to be excellent in HAZ toughness (acceptable).

(5) Method for Measuring Number Density of Oxide Grains

In order to measure, about each of the steel plates obtained as described, oxide grains present in any position in the plate thickness direction, an FE-SEM (field emission type scanning electron microscope; observing magnifications: 5000) was used to examine 40 visual fields (total area: 0.0172 $mm^2$) of the plate. Out of individual inclusion grains present in each of the visual fields, each inclusion grain having a maximum diameter of 2 μm or less was measured at the center thereof through an EDS attached to the FE-SEM. Out of the inclusion grains, grains containing, as constituent elements, at least REMs, Zr and O were judged to be each an oxide grain. The number density of the grains was measured (on average).

In the measurement, inclusion grains having a maximum diameter of 0.2 μm or more, out of all the observed grains, were analyzed. Inclusion grains having a maximum diameter less than 0.2 μm, out of the observed grains, were low in the reliability of the measurement result through the EDS; thus, these gains were not analyzed.

In the present examples, any steel plate about which the number density of the thus-measured oxide grains was 200/$mm^2$ or more, out of all the plates, was judged to be acceptable.

(6) Respective Brinell Hardnesses of Surface and Internal Portion of Each Steel Plate In accordance with JIS Z 2243, a measurement was made about the Brinell hardness of each of the surface and an internal portion (t/2 position) of each of the thus obtained steel plates (the hardness was a hardness in a direction parallel to the plate thickness direction). The measurement was repeated 3 times, and the average thereof was calculated. In the present examples, any steel plate about which the thus obtained Brinell hardness of each of the surface and the internal portion was 360 or more (on average), out of all the plates, was judged to be acceptable.

These results are shown in Table 2. In Table 2, Nos. 1 and 2 were examples in which the same steel species (steel species A in Table 1) was used. No. 1 was a quenched steel plate (Q steel plate) while No. 2 was a quenched and tempered steel plate (QT steel plate). Equivalently, Nos. 3 and 4 were examples in which the same steel species (steel species B in Table 1) was used, and No. 3 was a quenched steel plate (Q steel plate) while No. 4 was a quenched and tempered steel plate (QT steel plate). Martensite in Nos. 2 and 4 denotes tempered martensite.

TABLE 1

| Steel | Components (% by mass) in each steel (the balance: iron and inevitable impurities) | | | | | | | | | | | | | | | |
|---|---|---|---|---|---|---|---|---|---|---|---|---|---|---|---|---|
| species | C | Si | Mn | P | S | Al | Ni | Cr | Mo | Nb | Ti | B | N | REM | Zr | Ceq |
| A | 0.141 | 0.36 | 1.21 | 0.005 | 0.0025 | 0.049 | | 0.15 | 0.32 | 0.020 | | 0.0008 | 0.0027 | 0.0019 | 0.0013 | 0.44 |
| B | 0.141 | 0.35 | 1.20 | 0.005 | 0.0024 | 0.048 | 0.15 | 0.10 | 0.31 | 0.020 | | 0.0009 | 0.0030 | 0.0016 | 0.0014 | 0.43 |
| C | 0.131 | 0.34 | 1.20 | 0.005 | 0.0020 | 0.049 | | 0.11 | 0.28 | 0.020 | | 0.0009 | 0.0029 | 0.0016 | 0.0012 | 0.41 |
| D | 0.139 | 0.42 | 1.07 | 0.006 | 0.0022 | 0.051 | | 0.19 | 0.35 | 0.014 | | 0.0014 | 0.0032 | 0.0017 | 0.0013 | 0.43 |
| E | 0.138 | 0.23 | 1.34 | 0.007 | 0.0025 | 0.052 | | 0.10 | 0.31 | 0.025 | | 0.0007 | 0.0035 | 0.0018 | 0.0013 | 0.44 |
| F | 0.136 | 0.35 | 1.20 | 0.013 | 0.0027 | 0.047 | | 0.15 | 0.32 | 0.020 | | 0.0010 | 0.0050 | 0.0027 | 0.0019 | 0.43 |
| G | 0.140 | 0.35 | 1.20 | 0.018 | 0.0024 | 0.048 | | 0.15 | 0.32 | 0.020 | | 0.0009 | 0.0049 | 0.0012 | 0.0008 | 0.43 |
| H | 0.139 | 0.35 | 1.22 | 0.018 | 0.0034 | 0.051 | | 0.15 | 0.33 | 0.021 | | 0.0009 | 0.0053 | 0.0016 | | 0.44 |
| I | 0.137 | 0.34 | 1.20 | 0.018 | 0.0033 | 0.049 | | 0.15 | 0.32 | 0.020 | | 0.0008 | 0.0056 | | 0.0012 | 0.43 |
| J | 0.134 | 0.36 | 1.21 | 0.018 | 0.0026 | 0.051 | | 0.15 | 0.32 | 0.020 | | 0.0008 | 0.0051 | | | 0.43 |
| K | 0.139 | 0.35 | 1.21 | 0.018 | 0.0027 | 0.050 | 0.16 | 0.10 | 0.32 | 0.020 | | 0.0009 | 0.0051 | | | 0.44 |
| L | 0.166 | 0.35 | 1.30 | 0.018 | 0.0034 | 0.047 | | 0.16 | 0.32 | 0.020 | | 0.0009 | 0.0047 | 0.0017 | 0.0014 | 0.48 |
| M | 0.118 | 0.35 | 1.12 | 0.018 | 0.0032 | 0.047 | | 0.13 | 0.26 | 0.020 | | 0.0009 | 0.0051 | 0.0019 | 0.0015 | 0.38 |
| N | 0.134 | 0.35 | 1.21 | 0.018 | 0.0038 | 0.048 | | 0.15 | 0.32 | 0.020 | 0.019 | 0.0010 | 0.0049 | 0.0018 | 0.0015 | 0.43 |
| O | 0.139 | 0.36 | 1.21 | 0.005 | 0.0017 | 0.051 | | 0.10 | 0.20 | 0.020 | | 0.0010 | 0.0025 | 0.0019 | 0.0012 | 0.40 |
| P | 0.141 | 0.35 | 1.21 | 0.018 | 0.0024 | 0.048 | | 0.15 | 0.32 | 0.020 | | 0.0009 | 0.0048 | 0.0033 | 0.0022 | 0.44 |
| Q | 0.136 | 0.36 | 1.21 | 0.018 | 0.0035 | 0.048 | | 0.15 | 0.32 | 0.020 | | 0.0009 | 0.0051 | 0.0007 | 0.0002 | 0.43 |
| R | 0.152 | 0.35 | 1.20 | 0.005 | 0.0017 | 0.049 | | 0.19 | 0.36 | 0.019 | | 0.0009 | 0.0028 | 0.0016 | 0.0015 | 0.46 |

TABLE 2

| | | | | Microstructures after quenching (or quenching and tempering) | | Tensile properties (MPa) | | Brinell hardnesses | | Impact test | | Oxide grain |
|---|---|---|---|---|---|---|---|---|---|---|---|---|
| | Steel species | Production method | | Martensite | Bainite | | | | | $vE_{-70}$ | HAZ toughness | number density |
| No. | in Table 1 | Q(° C.) | T(° C.) | (%) | (%) | YP | TS | Surface | t/2 | (J) | (J) at O° C. | (/$mm^2$) |
| 1 | A | 930 | — | 91 | 9 | 1021 | 1247 | 397 | 394 | 27 | 151 | 233 |
| 2 | | 930 | 350 | | | 1075 | 1197 | 376 | 371 | 21 | | |
| 3 | B | 930 | — | 88 | 12 | 1112 | 1233 | 392 | 385 | 30 | 111 | 349 |
| 4 | | 930 | 350 | | | 1099 | 1181 | 370 | 360 | 20 | | |

TABLE 2-continued

| No. | Steel species in Table 1 | Production method Q(° C.) | Production method T(° C.) | Microstructures after quenching (or quenching and tempering) Martensite (%) | Microstructures after quenching (or quenching and tempering) Bainite (%) | Tensile properties (MPa) YP | Tensile properties (MPa) TS | Brinell hardnesses Surface | Brinell hardnesses t/2 | Impact test $vE_{-70}$ (J) | HAZ toughness (J) at O° C. | Oxide grain number density (/mm$^2$) |
|---|---|---|---|---|---|---|---|---|---|---|---|---|
| 5 | C | 930 | — | 30 | 70 | 998 | 1175 | 386 | 365 | 25 | 135 | 291 |
| 6 | D | 930 | — | 90 | 10 | 1051 | 1235 | 401 | 393 | 32 | 117 | 233 |
| 7 | E | 930 | — | 89 | 11 | 1022 | 1240 | 399 | 392 | 25 | 107 | 349 |
| 8 | F | 930 | — | 91 | 9 | 1027 | 1253 | 391 | 378 | 27 | 115 | 291 |
| 9 | G | 930 | — | 90 | 10 | 958 | 1204 | 392 | 375 | 27 | 147 | 233 |
| 10 | H | 930 | — | 92 | 8 | 1056 | 1248 | 389 | 381 | 24 | 87 | 116 |
| 11 | I | 930 | — | 89 | 11 | 1046 | 1243 | 376 | 368 | 25 | 82 | 174 |
| 12 | J | 930 | — | 87 | 13 | 1017 | 1223 | 386 | 380 | 24 | 84 | 58 |
| 13 | K | 930 | — | 85 | 15 | 970 | 1198 | 397 | 380 | 25 | 89 | 58 |
| 14 | L | 930 | — | 94 | 6 | 1029 | 1342 | 417 | 405 | 23 | 34 | 233 |
| 15 | M | 930 | — | 16 | 84 | 850 | 1083 | 379 | 323 | 29 | 105 | 349 |
| 16 | N | 930 | — | 86 | 14 | 950 | 1211 | 385 | 376 | 17 | 50 | 233 |
| 17 | O | 930 | — | 27 | 73 | 831 | 1149 | 379 | 330 | 23 | 109 | 291 |
| 18 | P | 930 | — | 90 | 10 | 1017 | 1247 | 394 | 379 | 27 | 86 | 291 |
| 19 | Q | 930 | — | 89 | 11 | 972 | 1200 | 390 | 375 | 25 | 83 | 116 |
| 20 | R | 930 | — | 92 | 8 | 1105 | 1323 | 398 | 390 | 32 | 67 | 291 |

Nos. 1 to 9 in Table 2 were working examples produced using the respective steel species A to G in Table 1 satisfying the requirements (about the components and the Ceq) of the invention, and further the microstructure proportions, and the oxide grain number density thereof were also appropriately controlled. Thus, besides having a high strength of TS 1100 MPa, these were excellent in both of base metal toughness and HAZ toughness. These were also excellent in abrasion resistance since the surface hardness and the internal hardness were also appropriately controlled.

By contrast, the following comparative examples had inconveniences described below:

No. 10 in Table 2 was an example wherein the steel species H in Table 1 containing no Zr was used. The specified oxide grain number density was not obtained so that the HAZ toughness was lowered.

No. 11 in Table 2 was an example wherein the steel species I in Table 1 containing no REM was used. The specified oxide grain number density was not obtained so that the HAZ toughness was lowered.

Nos. 12 and 13 in Table 2 were examples wherein the steel species J and K in Table 1 each containing neither REM nor Zr were used, respectively (No. 13: Ni-added example). The specified oxide grain number density was not obtained so that the HAZ toughness was lowered.

No. 14 in Table 2 was an example wherein the steel species L in Table 1 having a large C content and a large Ceq (IIW) was used. The HAZ toughness was lowered.

No. 15 in Table 2 was an example wherein the steel species M in Table 1 having a small Ceq (IIW) was used. The proportion of martensite was small so that the desired strength was not obtained. The inside of the steel plate was also lowered so that the desired abrasion resistance was not obtained.

No. 16 in Table 2 was an example wherein the steel species N in Table 1, to which Ti was added, was used. Both of the base metal toughness and the HAZ toughness were lowered.

No. 17 in Table 2 was an example wherein the steel species O in Table 1 having a small Mo content was used. The proportion of martensite was small so that the hardness of the inside of the steel plate was not obtained as desired.

No. 18 in Table 2 was an example wherein the steel species P in Table 1 having large REM and Zr contents was used. The HAZ toughness was lowered.

No. 19 in Table 2 was an example wherein the steel species Q in Table 1 having a small Zr was used. The specified oxide grain number density was not obtained so that the HAZ toughness was lowered.

No. 20 in Table 2 was an example wherein the steel species R in Table 1 having a large Ceq (IIW) was used. The HAZ toughness was lowered.

From the above-mentioned examples, it has been understood that in order to obtain a thick steel plate which has a high strength of 1100 MPa or more while the plate is excellent in both of base metal toughness and HAZ toughness and preferably in abrasion resistance, it is important that the requirement of the invention about the components in the steel is satisfied by the steel, and further the Ceq, the microstructures the oxide grain number density of the steel and preferably the hardness of any surface and the inside of the steel plate are controlled into the respective ranges.

What is claimed is:

1. A steel plate, comprising the following as components in the steel:

C: 0.10 to 0.16% provided that the symbol "%" means "% by mass" and hereinafter the same matter is applied to any symbol "%" described in connection with each of the components, Si: 0.2 to 0.5%, Mn: 1 to 1.4%, P: 0.03% or less, S: 0.01% or less, Al: 0.010 to 0.08%, Cr: 0.03 to 0.25%, Mo: 0.25 to 0.4%, Nb: 0.01 to 0.03%, B: 0.0003 to 0.002%, N: 0.006% or less, REMs: 0.0005 to 0.0030%, Zr: 0.0003 to 0.0020%, Fe and one or more inevitable impurities as the component-balance of the steel, wherein the Ceq (IIW) represented by the following equation ranges from 0.40 to 0.45 both inclusive:

$$Ceq(IIW)=[C]+\{1/6\times[Mn]\}+\{1/5\times([Cr]+[Mo]+[V])\}+\{1/15\times([Cu]+[Ni])\}$$

in which each parenthesis-symbol [ ] means the content by percentage of one of the elements in the parentheses, and grains of one or more oxides that each have a maximum diameter of 2 μm or less are present in a number density of 200/mm$^2$ or more in the steel, martensite microstructure is contained in a proportion of 29% or more by volume, and the microstructure-balance of the steel is bainite microstructure, the steel plate having a plate thickness of 6 mm or more and a tensile strength of 1100 MPa or more.

2. The steel plate according to claim 1, comprising Ni: 0.25% or less.

3. The steel plate according to claim 1, wherein grains of one or more oxides that each have a maximum diameter of 2 μm or less are present in a number density of 230/mm$^2$ or more in the steel.

4. The steel plate according to claim 1, wherein the base metal toughness of the steel plate measured by Charpy impact testing for absorbed energy at −70° C. is $vE_{-70} \geq 20$ J.

5. The steel plate according to claim 1, wherein the HAZ toughness of the steel plate measured by Charpy impact testing for absorbed energy at 0° C. is $VE_0 \geq 100$ J.

6. The steel plate according to claim 4, wherein the HAZ toughness of the steel plate measured by Charpy impact testing for absorbed energy at 0° C. is $VE_0 \geq 100$ J.

* * * * *